US007286672B2

(12) United States Patent
Roeck

(10) Patent No.: US 7,286,672 B2
(45) Date of Patent: Oct. 23, 2007

(54) BINAURAL HEARING DEVICE AND METHOD FOR CONTROLLING A HEARING DEVICE SYSTEM

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 512 days.

(21) Appl. No.: 10/383,407

(22) Filed: Mar. 7, 2003

(65) Prior Publication Data

US 2004/0175005 A1 Sep. 9, 2004

(51) Int. Cl.
*H04R 25/00* (2006.01)

(52) U.S. Cl. ..... 381/23.1; 381/313; 381/315

(58) Field of Classification Search ..... 381/313, 381/314, 315, 23.1
See application file for complete search history.

(56) References Cited

U.S. PATENT DOCUMENTS

| | | | | |
|---|---|---|---|---|
| 4,773,095 | A | 9/1988 | Beckenbauer et al. | |
| 5,991,419 | A | 11/1999 | Brander | |
| 6,389,142 | B1 * | 5/2002 | Hagen et al. | 381/313 |
| 6,449,216 | B1 * | 9/2002 | Roeck | 367/124 |
| 7,206,421 | B1 * | 4/2007 | Taenzer | 381/119 |
| 2002/0004695 | A1 | 4/2002 | Beck et al. | |
| 2002/0041695 | A1 * | 4/2002 | Luo | 381/313 |
| 2004/0175005 | A1 | 9/2004 | Roeck | |

FOREIGN PATENT DOCUMENTS

| | | |
|---|---|---|
| WO | 99/04598 | 1/1999 |
| WO | 99/09786 | 2/1999 |
| WO | 99/43185 | 8/1999 |
| WO | 00/54553 | 9/2000 |
| WO | 00/68703 | 11/2000 |
| WO | 01/20965 A2 | 3/2001 |
| WO | 01/22790 A2 | 4/2001 |
| WO | 02/32208 A2 | 4/2002 |

OTHER PUBLICATIONS

"Directional Hearing Aid" NTIS Tech Notes, U.S. Department of Commerce. Springfield, VA, US, Sep. 1, 1989, pp. 798, 1-2, XP000100127 ISSN: 0889-8464.

Harford E. et al.: "A Rehabilitative Approach to the Problem of Unilateral Hearing Impairment: The Contralateral Routing of Signals (CROS)", Journal of Speech and Hearing Disorders, America Speech and Hearing Association, Danville, IL., US, vol. 30, No. 2, May 1965, pp. 121-138, XP009008743, ISSN: 0022-4677.

* cited by examiner

*Primary Examiner*—Daniel Swerdlow
(74) *Attorney, Agent, or Firm*—Pearne & Gordon LLP

(57) ABSTRACT

A binaural hearing device system comprises a reception device (1) for one ear with at least two input acoustical/electrical converters (3*a*, 3*b*). Via a communication link (5) a signal ($A_1$) which depends on both input converter's output signals is transmitted to a second device (7) for the other ear which comprises at least an output electrical/mechanical converter.

24 Claims, 6 Drawing Sheets

BINAURAL HEARING DEVICE AND METHOD FOR CONTROLLING A HEARING DEVICE SYSTEM

Figure 1:
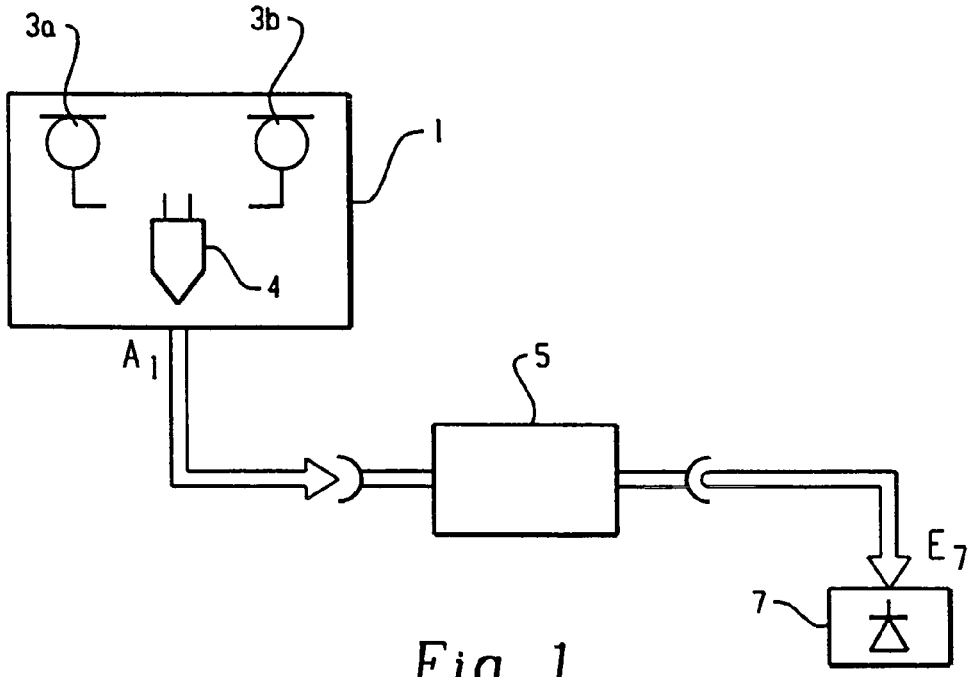

The present invention is most generically directed on binaural hearing device systems which necessitate a communication link between a device arranged in or a adjacent one ear and a device in or adjacent the other ear of an individual. The one-ear device comprises at least an arrangement of input acoustical/mechanical converters whereas the other ear device at least comprises an output electrical/mechanical converter.

From the WO 99/43185 such a binaural hearing device system is known, whereat each device associated to an ear comprises an input acoustical/electrical converter and an output electrical/mechanical converter. There is further provided a communication link between the two devices whereby data or signals are cross communicated via such link which are respectively dependent from the output signals of the respectively provided acoustical/electrical input converters. Thereby before the respective converter output signals are applied to the communication link they are analogue/digital converted whereby there may be implemented in the respective analogue/digital converters some additional signal preprocessing.

Today's monaural hearing devices customarily have at least two input acoustical/electrical converters for beamforming purposes. The binaural system according to the WO 99/43185 may be tailored to provide beamforming by using the two input converters provided at the respective one ear attributed devices. Thereby, as outlined above, data are cross-transmitted via the communication link which are possibly preprocessed but which comprise substantially more information than really needed. Further beamforming with two input converters placed one on each side of individuals head may be quite complex and inaccurate e.g. due to the head-related acoustical transfer functions HRTF which describe the effects of acoustical signals being "shadowed" by individuals head. Such shadowing occurs, dependent on direction of arrival of acoustical signals, asymmetrically with respect to both ears which on one hand allows spatial perception, on the other hand renders beamforming quite complex.

It as an object of the present invention to provide a binaural hearing device system and respectively a method for controlling such hearing device system whereat the technique of providing at least two input acoustical/electrical converters at one ear's device is maintained as known from monaural devices and additionally there is nevertheless applied to the communication link only one signal or data which is thereby dependent from the output signals of both of the at least two input converters at one ear's device. Thereby a significantly reduced amount of data is transmitted via said link compared with a case where, following the concept of the WO 99/43185, output signals of each input converter are separately transmitted via the link.

This object is resolved by the binaural hearing device system according to the present invention which comprises a first device for one ear of an individual, a second device for the other ear, a data/signal communication link between the first and the second device whereby the first device comprises at least a reception unit with at least two input acoustical/electrical converters and a signal processing unit the inputs of which being operationally connected to the electrical outputs of the at least two converters and which generates at a combined output a signal which is dependent on signals at both the said inputs whereby the signal link is provided at the output side of such processing unit and transmits data signals which depend upon the output signal of the processing unit whereby the second device comprises at least an output electrical/mechanical converter.

As is known to the skilled artisan there exist so called Complete-In-the-Channel, CIC-hearing devices whereat, due to complete introduction in the ear channel only one input acoustical/electrical converter is provided. Thereby whenever instead of the device mentioned above with at least two input converters, a CIC with only one input acoustical/electrical converter is to be applied according to the present invention's general concept, significant information and data reduction is achieved before transmitting data to the communication link, in that there is provided between the output of the one input converter and the communication link, a Wiener-Filter.

As was mentioned above the system according to the present invention provides in one embodiment the first device to be applied to one ear not having an electrical/mechanical output converter and thus only having in a reception unit the at least two acoustical/electrical input converters. This embodiment might be most valid e.g. if on any reason it is not possible to apply a device with at least two input converters at that ear where hearing shall be improved.

Thereby the second device does not comprise an input acoustical/electrical converter irrespective whether the first device has an output converter or not.

In a further preferred embodiment an output electrical/mechanical converter provided at the first device is operationally connected to the output of the processing unit and is thus driven by a combined signal or data dependent on both outputs of the at least two input acoustical/electrical converters provided.

In a still further preferred embodiment the system according to the present invention has the reception unit of the first device as a first reception unit whereby the at least two input acoustical/electrical converters thereat are first acoustical/electrical converters. Additionally the signal processing unit still at the first device is a first signal processing unit.

Further the output electrical/mechanical converter at the second device is considered as a second output electrical/mechanical converter. The first device comprises a first output electrical/mechanical converter and the second device a second reception unit.

Thus both devices for each of the two ears have respective reception units and thus input acoustical/electrical converters and respective output electrical/mechanical converters.

Nevertheless the second reception unit at the second device needs not necessarily have more than one input acoustical/electrical converter although providing also there at least two input acoustical/electrical converters is preferred.

Further the communication link which is provided in all embodiments according to the present invention, for communicating between devices adjacent or in the respective ears, maybe wirebound and/or based on optical fiber and/or on wireless communication.

Whenever both ears devices are equipped with input acoustical/electrical converters in a preferred embodiment both devices are equipped with at least two of such converters which gives the possibility to provide at both devices beamforming ability. Thereby further preferably also the second reception unit is equipped with a signal processing unit whereby, further preferred, the inputs of such processing unit are operationally connected to the electrical outputs of the second input converters at the second reception unit.

This processing unit generates at a respectively second output a signal which is dependent on signals at both said inputs of the second signal processing unit whereby the signal link is provided at the output side of the second signal processing unit. Thus via the addressed signal or communication link combined signals dependent respectively on the output signal of at least two input converters are bidirectionally transmitted from one device to the other and vice versa.

Thereby and in a further preferred mode or embodiment the output of the first signal processing unit is operationally connected to a first input of a weighting unit and the output of a second signal processing unit is operationally connected to a second input of the weighting unit. The weighting unit has a first output which is operationally connected to an input of a first output converter and has a second output which is operationally connected to the input of the second output converter. Thereby the weighting unit may be construed decentralised e.g. in both devices. The weighting unit has a control input and varies operational connection or signal transfer between the first input and the first output, the first input and the second output, the second input and the first output and finally the second input and the second output. Such signal transfers are controlled by a signal or data applied to the control input of said weighting unit. Thereby such operational connections between respective inputs and outputs are formed preferably frequency or frequency-band specifically and the respective functions which are controlled independently from one another are possibly but not necessarily complex functions.

So as to determine how the operational connections between respective inputs and outputs at the weighting unit have to be controlled, especially according to the acoustical surrounding present, the control input of the weighting unit is preferably connected to an output of a classification unit which later has at least one input operationally connected to an output of at least one of the reception units.

In a further most preferred embodiment the first device comprises a beamformer unit which has a beamcontrol input and an output. Via the beamcontrol input the directional characteristic of the beam as an amplification characteristic in dependency of spatial angle at which an acoustical signal impinges on the device, may be varied.

There is further provided a detection unit for detecting the direction of arrival of an acoustical signal which impinges upon the reception unit which unit generates at an output an output signal in dependency of said direction of arrival. This output is operationally connected to the beamcontrol input of the beamformer unit so that e.g. a source of acoustical signal the direction of arrival of which having been detected may be more accurately tracked by accordingly directing a maximum amplification direction of the beam upon such a source. Accordingly a source, as e.g. a noise source, the direction thereof having been detected may be cancelled by controlling the beam so that it establishes in that noise source direction minimum amplification.

As was mentioned above in a preferred embodiment there is provided a weighting unit whereat signal transmission between respective inputs and outputs is controlled. Thereby control of such signal transmission is made dependent from the result achieved in a classification unit the input thereof being operationally connected to at least one output of at least one of the reception units.

Departing from this embodiment and in a further preferred mode there is provided at the system a determination unit for the direction of arrival of an acoustical signal impinging on at least one of the devices whereby such direction determination unit is interconnected between at least one input of the classification unit and at least one output of at least one of the reception units at the devices.

Thus the classification which finally controls signal transfer at the weighting unit at least comprises classification of signals which depend on direction of arrival. Thereby and as a further improvement of such embodiment there is provided at least one histogram forming unit, the input thereof being operationally connected to at least one output of at least one of the reception units. The output thereof is operationally connected to an input of the classification unit. Thus classification at least comprises classification based on a histogram result. Most preferably and with an eye on providing a direction of arrival determination unit such histogram forming unit is provided with an input operationally connected to an output of the determination unit and an output operationally connected to the classification unit. Thereby classification at least comprises classification of a histogram function of a signal or of signals which identify such direction of arrival.

The object mentioned above still further is resolved by the method for controlling a hearing device system which comprises at least a reception unit at a first device for one ear which has at least two inputs acoustical/electrical converters and at least an output electrical/mechanical converter at a second device for the other ear and a communication link between the first and the second device which method comprises the steps of generating in dependency of output signals of the at least two input converters a combined signal and transmitting such combined signal via the communication link.

For applying the method according to the present invention to CIC hearing devices the method according to the invention comprises providing instead of the at least two input converters only one converter and construing the first device as a device to be completely introduced into the ear channel and further comprises a step to treat the output of the one input converter by a Wiener-Filter and transmitting signals dependent from the output of the Wiener-Filter via the communication link.

The present invention and the object thereof is further resolved by the method for producing a drive signal for a electrical/mechanical output converter of a binaural hearing device which method comprises the steps of acoustical/electrical converting impinging acoustical signals at at least two input converters of a device to be applied adjacent individuals one ear, transmitting a combined signal dependent from both said convertings via a link to a further device to be applied adjacent or in individuals other ear and generating the drive signal in dependency of the transmitted signal.

Further preferred embodiments of the methods according to the present invention as well as of the system according to the present invention will become apparent to the skilled artisan when reading the following description of preferred embodiments of the present invention as well as the claims.

Figure 2:
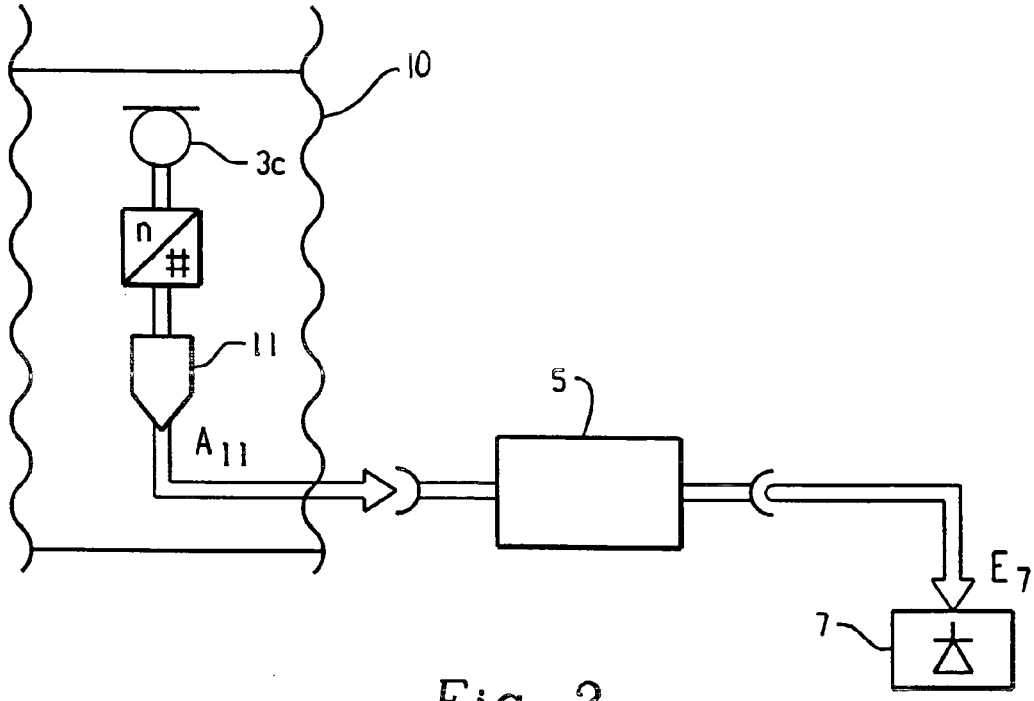
Figure 4:
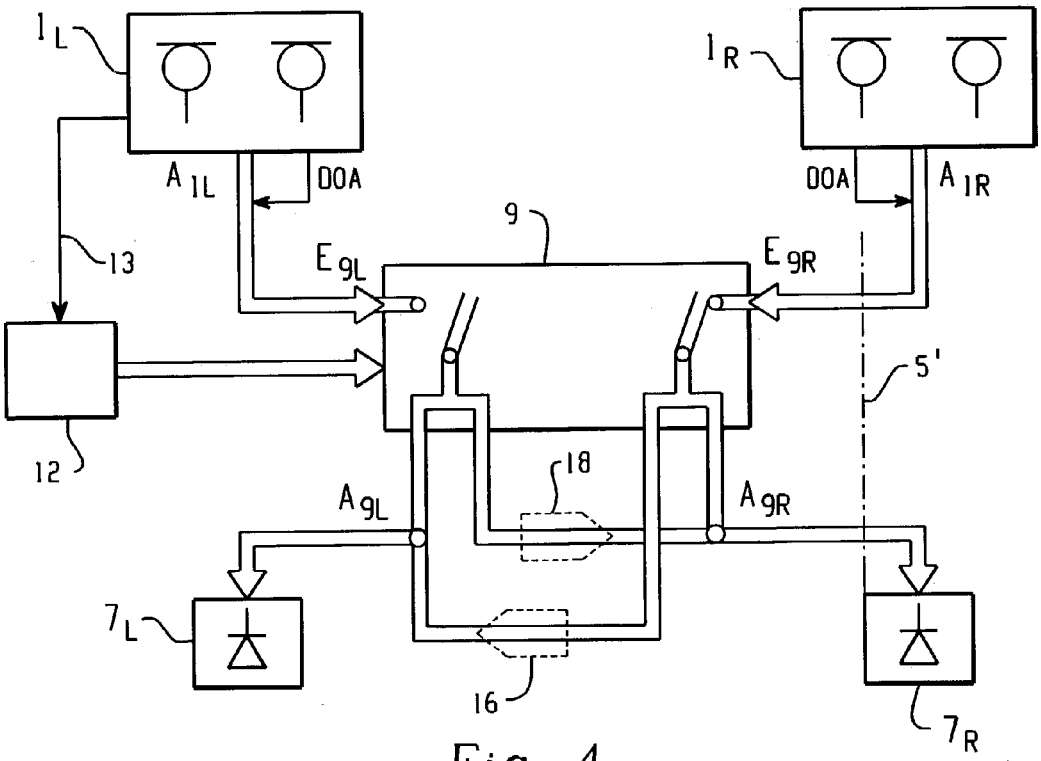
Figure 5:
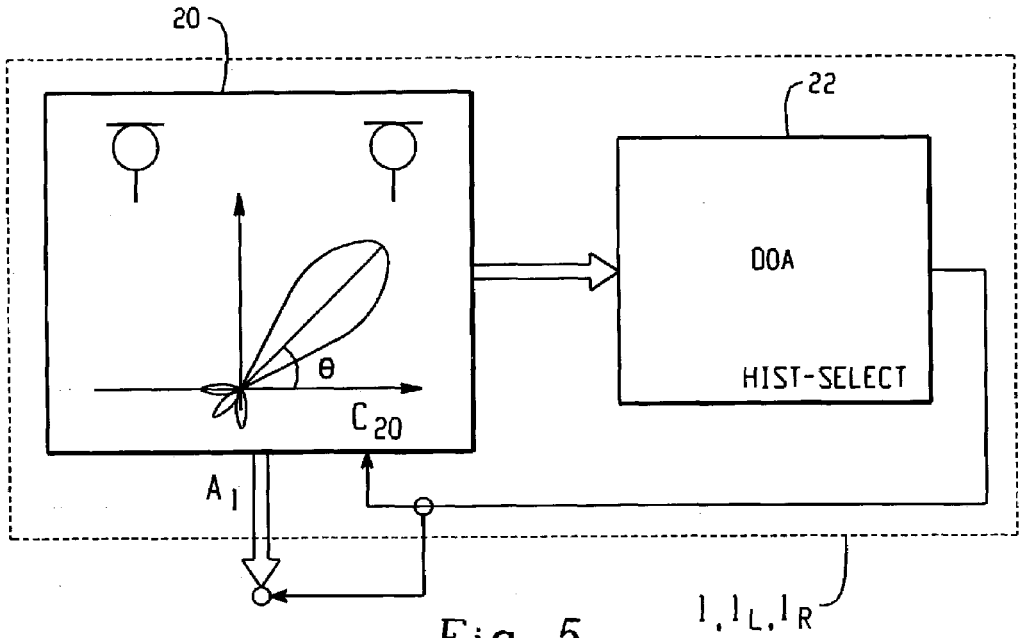
Figure 6:
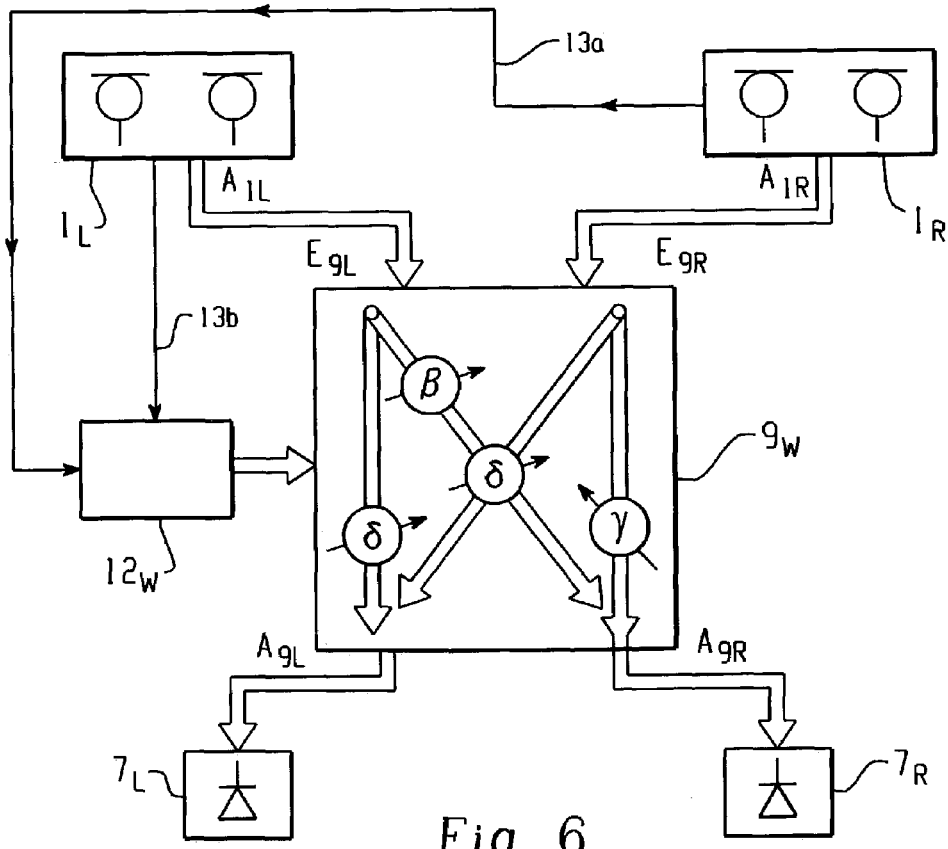
Figure 8:
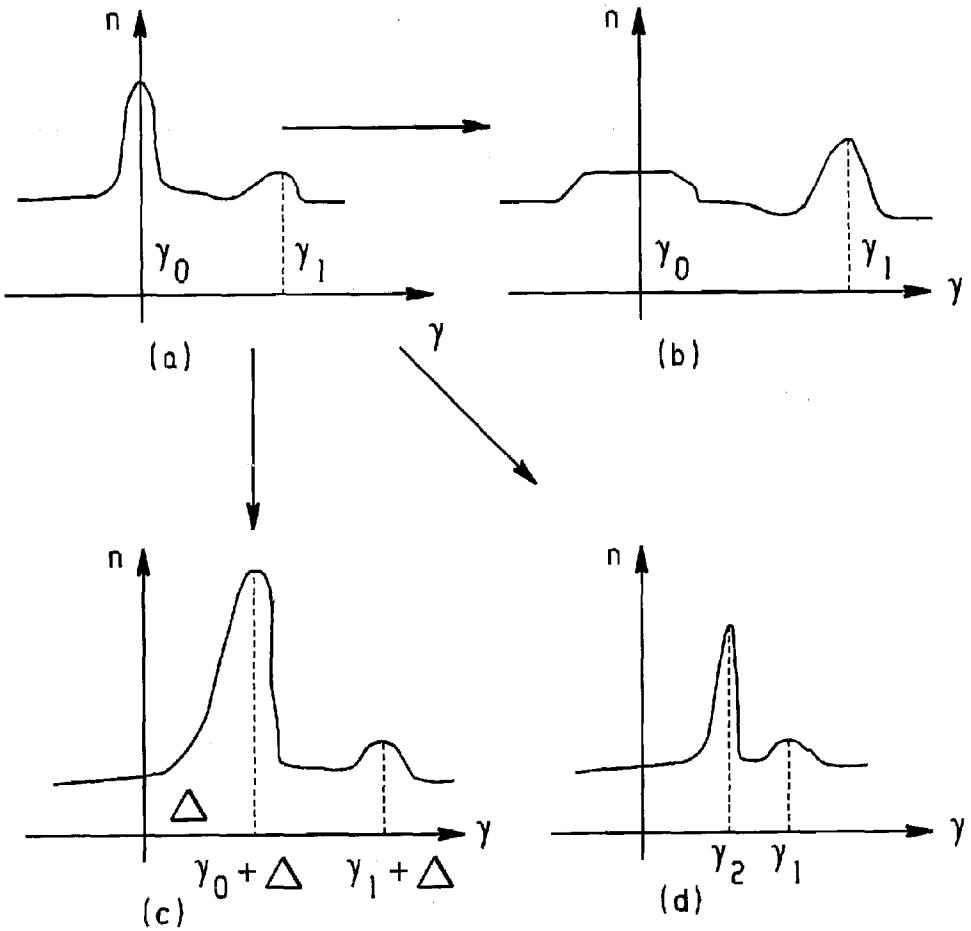
Figure 7:
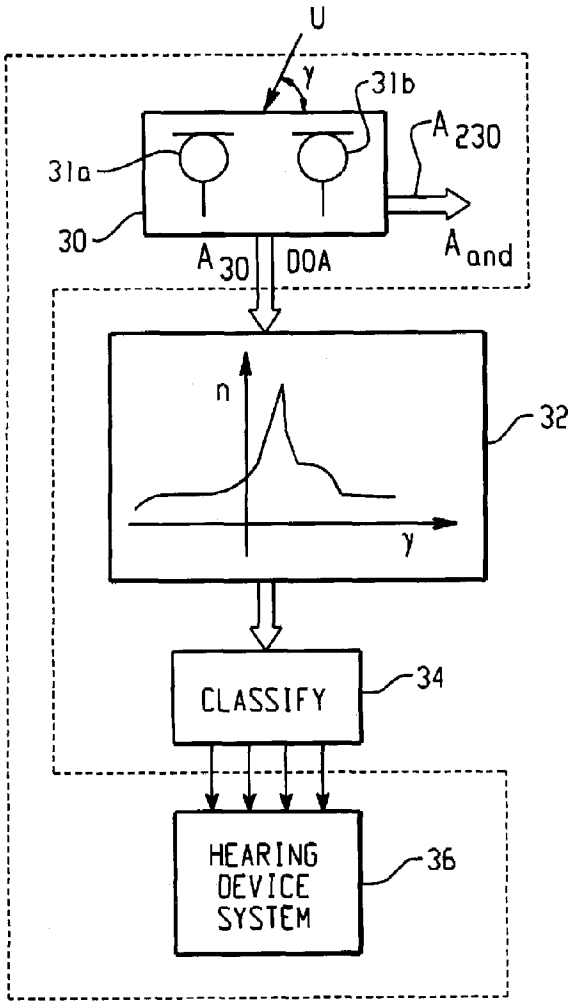
Figure 9:
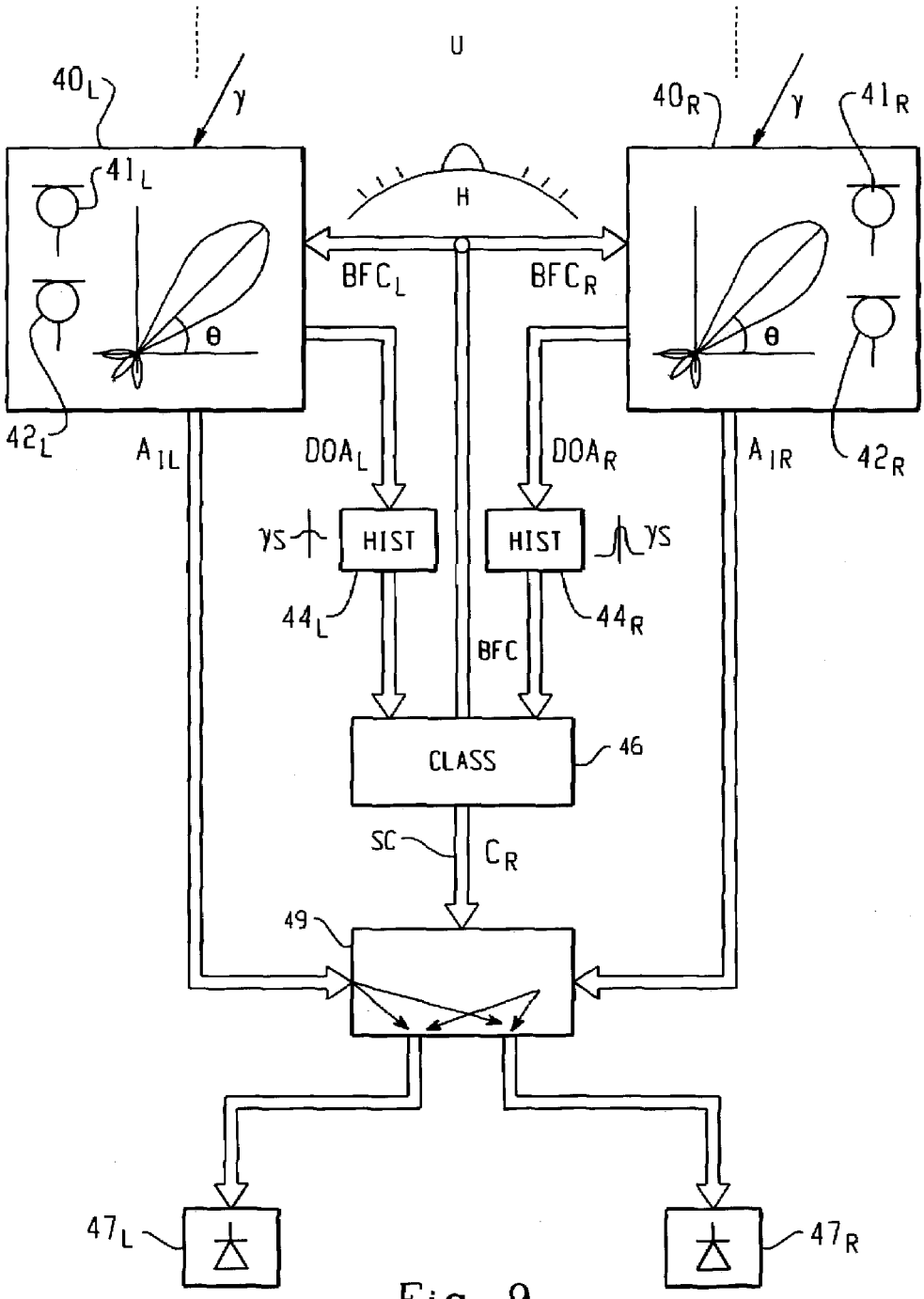
Figure 10:
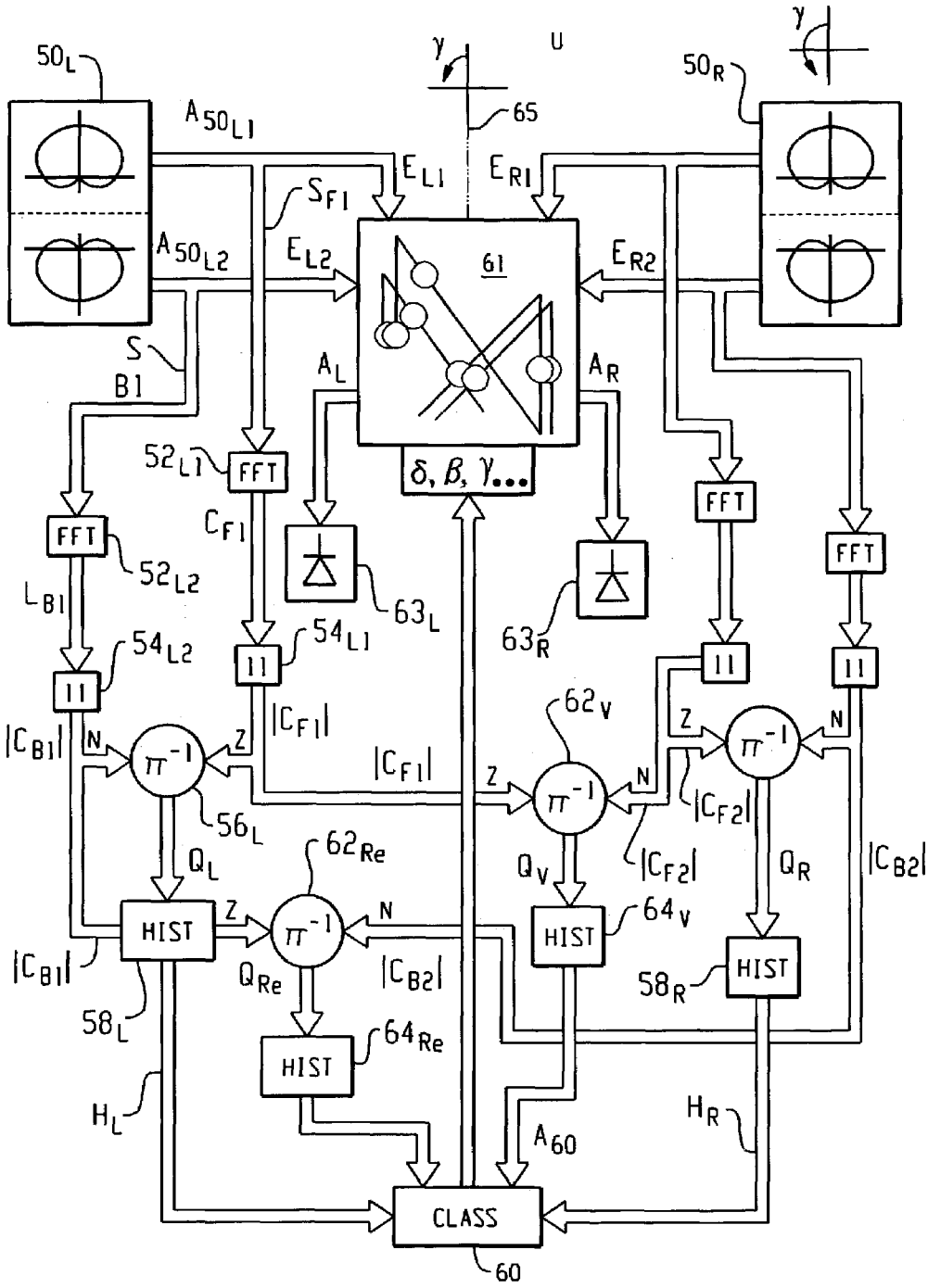

The present invention will now be further described with the help of figures. They show examples of preferred embodiments, namely:

FIG. 1 By a schematic, simplified functional-block/signal-flow representation, a first embodiment of the system according to the present invention and operated according the methods of the present invention;

FIG. 2 in a representation form in analogy to that of FIG. 1 a further embodiment of the present invention;

FIG. 3 again in a simplified schematic functional-block/signal-flow representation a still further embodiment according to the present invention again operating according to the methods of the present invention;

FIG. 4 still in the same representation form a further embodiment of the present invention;

FIG. 5 by means of a simplified schematic functional-block/signal-flow representation a subembodiment for automatic beamcontrol e.g. to track acoustical sources and/or to cancel reception of acoustical sources. Such embodiment may preferably be incorporated within the embodiments according to the present invention;

FIG. 6 departing from a system or methods according to FIG. 4 still in a simplified schematic functional-block/signal-flow representation an improved embodiment of such system or methods;

FIG. 7 by means of a simplified schematic functional-block/signal-flow representation a system or method for controlling a hearing device as a function of direction of arrival of acoustical signals as detected and preferably classified;

FIG. 8 examples of direction of arrival behaviours as appearing on a histogram function to explain some of more simple classification criteria as preferably exploited at the system or methods of FIG. 7 as well as at systems or methods to be shown with the help of the FIGS. 9 and 10;

FIG. 9 in form of a simplified schematic functional-block/signal-flow representation an improved and today preferred form of an embodiment of the system according to the present invention and of the methods according to the present invention;

FIG. 10 departing from the representation of FIG. 9 a more detailed representation of such system or methods making use of direction of arrival detection as described in more details in the WO 00/68703 which accords with the U.S. application Ser. No. 09/636 443 and 10/180 585.

According to FIG. 1 a system according to the present invention operating according to the method of the present invention both under a first aspect thereof is schematically shown by means of a simplified functional block/signal flow diagram in a minimal configuration. There is provided an acoustical reception unit 1 with at least two acoustical/electrical converters 3*a* and 3*b*, both with a respective acoustical input and an electrical output. Reception unit 1 may incorporate e.g. respective analog to digital converters connected to the outputs of the converters 3*a*, 3*b*, time domain to frequency domain conversion units downstream such analog to digital converters and has a signal processing unit 4 for processing signals in dependency of the analog signals appearing at the outputs of the converters 3*a*, 3*b*. Processing unit 4 generates at an output $A_1$ of reception unit 1 a signal or data which is result of combined processing of signals dependent on the output signals of both converters 3*a* and 3*b*: The output signal at $A_1$ depends on the output signals of both converters 3*a*, 3*b*. This signal or data at output $A_1$ possibly further processed at respective signal processing units (not shown) generates a signal or data, which is dependent on the output signal or data at $A_1$, which is transmitted to a transmission link 5, which again may incorporate further signal processing. At the output side of transmission link 5 a signal or data, which is dependent on the signal appearing at the output $A_1$ of unit 1, is input to an input $E_7$ of an electrical/mechanical converter unit 7. Unit 1 is applied adjacent or within one of an individual's ears, unit 7 to the other.

The system as shown in FIG. 1 is in a preferred embodiment a hearing aid system i.e. a therapeutical system. Unit 7 is thereby an outside-the-ear or an inside-the-ear converter unit or an implanted or implantable unit. By this minimal system acoustical signals are received on one of individual's ears and control hearing at the other ear. Such a system may be provided, where on any reasons, applying the reception unit 1 is not possible or difficult on that ear where hearing shall be improved or reinstalled.

The concept of applying a reception unit as of unit 1 at or adjacent one ear and transmitting signals or data dependent on the received acoustical signals at such reception unit to the other ear for improving hearing at that other ear, this concept per se is considered inventive, irrespective of how reception unit, signal link to the other ear and a other's ear converter unit as of unit 7 of FIG. 1 are conceived: Under this concept one ear is only provided with an electrical/mechanical unit and no reception unit. The embodiments of FIGS. 1 to 3 clearly fall under such concept. In any case the link 5 may be electric wire based, optical fiber based or may be a wireless communication link.

The double-line arrows shown in FIG. 1 and following figures represent signal or data communication paths. Along such signal path additional signal processing by respective units may be established. The double-arrows may indicate a direct signal transmission, but rather stand for an operational connection, in which signals are transmitted and processed in direction of the arrow.

By the system according to FIG. 1 only data or signals are transmitted via transmission link 5, which have been preprocessed as by combining signals of at least two acoustical to electrical input converters 3*a*, 3*b*.

In FIG. 2 there is shown in a representation, in analogy to that of FIG. 1, a second preferred embodiment, which only differs from that of FIG. 1 in that unit 1 of FIG. 1 is now conceived as a unit 10 to be applied completely introduced in an individual's ear channel, a so-called CIC-device. As known to the skilled artisan such a CIC unit customarily has only one input acoustical to electrical converter 3*c*. By means of a digital signal processing unit 11, which is operationally connected e.g. via time domain to frequency domain converter and analog to digital converter to the analog output of converter 3*c*, at least a Wiener-filtering is performed. The output signal or data of converter 3*c* is processed by a Wiener filter to result in significantly preprocessed data and perceptual information reduction thus enabling simpler source/channel coding before being transmitted via communication link 5 to the electrical to mechanical converter unit 7.

Figure 3:
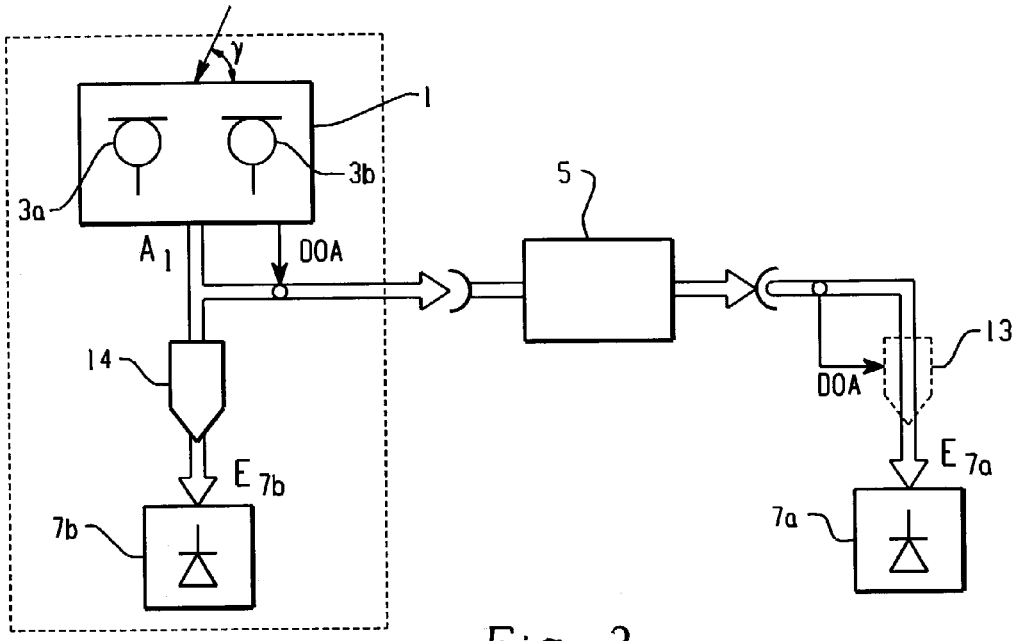

In FIG. 3 there is shown in a representation in analogy to that of the FIGS. 1 or 2 a further preferred embodiment of the system according to the present invention, which operates according to the method of the present invention. According to the system of FIG. 3, the difference to the system of FIG. 1 is that the output $A_7$ of reception unit 1 is not only, via transmission link 5, operationally connected to the input $E_7$ of the electric/mechanic converter unit 7 at the other of individual's ears, but output $A_1$ is additionally operationally connected to an electrical/mechanical converter unit 7*b*, which is provided at the same ear as reception unit 1.

It is evident that in dependency of the signals or data at output $A_1$ the left ear and the right ear units 7*a* and 7*b* have normally to be differently operated. Thus there are generically installed different and/or differently operating signal processing units as on one hand between the output $A_1$ and link 5, link 5 and input $E_{7a}$, and on the other hand output $A_1$ and input $E_{7b}$ of unit 7*b*. In the case of the embodiment of FIG. 3 and as shown in dashed-pointed frame, the units 1 and 7*b* are preferably incorporated in a unitary hearing device, especially in a hearing aid device being a behind- or an in-the-ear hearing device.

Instead of providing a reception unit 1 with at least two input acoustical to electrical converters 3*a* and 3*b* as of FIG. 3, this unit may be construed according to unit 10 of FIG. 2, i.e. as a CIC-unit.

According to the embodiment of FIG. 3 there is in fact established a MASTER-acoustical control by reception unit 1 at one ear of the individual, whereas a hearing device without an input acoustical to electrical converter unit is operated at the other ear as a SLAVE device.

Departing from the system and method as explained with the help of FIG. 3 a further preferred embodiment of the invention under the first aspect thereof is shown in FIG. 4, still in a representation in analogy to that of the FIGS. 1 to 3.

According to the system of FIG. 4 there is provided for the left ear of an individual a reception unit $\mathbf{1}_L$ and for the right ear a reception unit $\mathbf{1}_R$. Both reception units $\mathbf{1}_L$ and $\mathbf{1}_R$ are conceived with respect to signal or data processing as was explained with respect to reception unit 1 in context with FIG. 1. Instead of units $\mathbf{1}_R$ and $\mathbf{1}_L$ being conceived according to unit 1 of FIG. 1, one or both thereof may be conceived according to unit 10 of FIG. 2. A signal or data dependent from the signal or data at the output $A_{1L}$ of reception unit $\mathbf{1}_L$ is fed to an input $E_{9L}$ of a selection unit 9. A signal or data which is dependent from the signal or data appearing at the output $A_{1R}$ of the right ear reception unit $\mathbf{1}_R$ is fed to an input $E_{9R}$ of the selection unit 9. There is further provided a left ear electrical/mechanical output converter unit $\mathbf{7}_L$ and a right ear electrical/mechanical output converter unit $\mathbf{7}_R$.

The selection unit 9, as schematically shown by a switching arrangement, has an output $A_{9L}$ and an output $A_{9R}$ respectively operationally connected to the inputs of output converters $\mathbf{7}_L$, $\mathbf{7}_R$. Signals or data appearing at either of the outputs $A_{9L}$ or $A_{9R}$ may operationally be connected to both electrical to mechanical converter units $\mathbf{7}_L$ and $\mathbf{7}_R$. Under the control of a selection-control unit 12 and, as schematically shown in unit 9 by an arrangement of switches, the input $E_{9L}$ or the input $E_{9R}$ is operationally connected to both of the converters $\mathbf{7}_L$, $\mathbf{7}_R$. Thereby, whenever the operational signal or data connection within selection unit 9 is established according to that switching position shown in FIG. 4, both converters $\mathbf{7}_L$ and $\mathbf{7}_R$ are operationally connected to the right ear reception unit $\mathbf{1}_R$, and therefore the right ear reception unit $\mathbf{1}_R$ is the MASTER. In analogy, unit $\mathbf{1}_L$ becomes MASTER whenever the units $\mathbf{7}_L$ and $\mathbf{7}_R$ are operationally connected to the input $E_{9L}$ of selection unit 9.

In this embodiment again the right ear units $\mathbf{1}_R$ and $\mathbf{7}_R$ are preferably incorporated in a unitary right ear hearing device, be it a hearing aid device or be it a hearing device for other than therapeutical appliances. In analogy the units $\mathbf{1}_L$ and $\mathbf{7}_L$ are incorporated in a respective left ear unitary device. Such hearing devices may thereby be in-the-ear or outside-the-ear hearing devices or their output converters $\mathbf{7}_L$ and/or $\mathbf{7}_R$ may be construed as implantable devices. Further, the right and left ear devices do not necessarily have to be of the same type, e.g. an in-the-ear and an outside-the-ear hearing device may be combined, an outside-the-ear and an implant device etc.

Looking back on FIG. 3 it has been shown that the acoustical signal impinging on unit 1 at one ear, e.g. at the left year, binaurally controls both electrical to mechanical output converter units 7*a* and 7*b*. We have established that double-lined arrows stand for operational signal or data communication and not necessarily for direct connection. Thus, along operational connections processing as by processing units, especially DSP's, may be done. For example: As according to FIG. 3 the acoustical signals impinging on unit 1 do control both output converters 7 and thus the head-related transfer function HRTF for the SLAVE side with converter 7*a* is lost, there will preferably be provided as shown in dashed line a DSP 13 exclusively influencing signals or data input to the SLAVE converter 7*a* and whereat the respective HRTF is taken into account. So as to properly set the parameters of processing in DSP unit 13 for taking the HRTF functions into account, the reception unit 1 detects direction of arrival DOA as denoted by Φ in FIG. 3 and there will be transmitted additionally to the signal or data dependent from those appearing at output $A_1$ of unit 1, via link 5, a DOA-significant signal or data to DSP 13 as shown by signal DOA. Further, there will be preferably provided a DSP 14 just upstream the input $E_{7b}$ and DSP 13 or a further DSP to input $E_{7a}$ as well as DSP 14 will take in account different signal processing needs according to the hearing improvement needs at the respective ears.

When looking to the embodiment of FIG. 4 in analogy to the just given explanations with respect to the system of FIG. 3, whenever the right ear device is MASTER, the HRTF will preferably be considered for the left ear converter $\mathbf{7}_L$, i.e. the SLAVE and vice versa. Thus, the left ear HRTF is taken into account by a DSP 16, and the right ear HRTF by a DSP 18. Preferably that one of the units 1L and 1R, which acts as a MASTER, provides for data about direction of arrival DOA (not shown) so as to control the transfer characteristic of the respective HRTF DSP 16 and 18.

With an eye on FIG. 1 or 2, there the processing unit 4 will preferably take the HRTF of the left side ear into consideration.

With respect to one preferred possibility for detecting direction of arrival DOA of acoustical signals at the reception units 1, 10, 1L and 1R, we refer to the WO 00/68703 "Method for localizing direction" of the same applicant, wherein a technique for detecting such direction of arrival DOA is completely disclosed, and which shall be incorporated with respect to DOA detection into the present description. This WO 00/68703 accords with U.S. application Ser. No. 09/636 443 and Ser. No. 10/180 585. Thereby, the reception units 1, 1L, 1R may preferably further comprise beam formers as are e.g. described in the WO 00/54553, according to U.S. application Ser. No. 09/267 742, the WO 99/04598, according to U.S. application Ser. No. 09/146 784, the WO 99/09786, according to U.S. application Ser. No. 09/168 184, all of the same applicant.

Thus, in one preferred embodiment such units 1, 1L, 1R provide for both, namely beam forming as well as detection of DOA. Thereby, in a further preferred embodiment beamforming is controlled by the DOA.

This preferred form of realizing the reception units 1, 1L, 1R as discussed up to now is schematically shown in FIG. 5. Thereby, the units 1, 1L, 1R comprise a beamforming subunit 20 with at least two input acoustical/electrical converters. At the output of such unit, which accords to output $A_1$ or $A_{1L}$, $A_{1R}$ there appear electrical data or signals in dependency of acoustical signals impinging on the at least two input converters and amplified according to a predetermined characteristic in dependency of spatial angle with which the acoustical signals impinge on the input converters. The outputs of the acoustical to electrical converter are further exploited e.g. according to the teaching of the WO 00/68703 so as to provide for a signal which is indicative of the direction of arrival DOA of the acoustic signals. Thereby preferably and as described in the said WO 00/68703, there is performed a histogram of the DOA signals, as will be discussed later. The output of a histogram-forming and evaluating unit 22 controls beamformer unit 20 at a control input $C_{20}$ e.g. to track an acoustical source selected with high amplification or to delete such acoustical source by low amplification.

Turning back to the system of FIG. 4, it may be seen that the data link 5, which was shown in the FIGS. 1 to 3, has not been shown anymore. Such data link, by which signals or data are or is transmitted from one ear side to the other, may be provided in the system as of FIG. 5, wherever felt best. The selection unit 9 may e.g. be incorporated in one of the left ear or right ear devices, e.g. in the left ear device and then the addressed data link 5 will be provided at 5' as shown in FIG. 5. On the other hand the selection unit 9 may be split into left ear device- and right ear device-units, and then the data link 5 would be established and following the representation of FIG. 4 practically within selection unit 9.

Further, with an eye on FIG. 4, this system clearly operates one of the two devices as a MASTER, the other one, and thereby especially the output converter 7 thereof, as a SLAVE. Changing this MASTER/SLAVE relation occurs abruptly and it is not possible to gently control the MASTER/SLAVE weighting of the two devices. This becomes possible by the improvement on FIG. 4, which shall be explained with the help of FIG. 6.

According to FIG. 6, wherein units which correspond to units already described in context with FIG. 4 have been denoted with the same reference number, the selection unit $\mathbf{9}_w$ in fact is a weighting unit. Therein, the influence of a signal or data dependent from such signal or data at output $A_{1L}$ upon signal or data respectively appearing at the outputs $A_{9L}$ and $A_{9R}$ is continuously adjustable, as shown schematically by variable coefficients $\alpha$, $\beta$. In analogy the influence from output $A_{1R}$ upon the two outputs $A_{9L}$ and $A_{9R}$ of unit $\mathbf{9}_w$ is adjusted as schematically shown by variably controllable coefficients $\gamma$ and $\delta$. The coefficients $\alpha$, $\beta$, $\gamma$, $\delta$ are preferably frequency dependent or at least dependent from frequency bands and are possibly of complex value. These weighting coefficients are controlled by a selection control unit $\mathbf{12}_w$.

In the embodiments according to the FIGS. 5 and 6 there is provided respectively a selection control unit 12 or $\mathbf{12}_w$ not having been described yet. The selection control unit 12 and respectively $\mathbf{12}_w$ are in fact classification units, whereat the instantaneously prevailing acoustical environment and/or the time development in the past up to the present of such acoustical surrounding and even a trend estimation for future development of such acoustical signals is classified according to predetermined criteria as e.g. disclosed in the WO 02/32208 which accords with U.S. application Ser. No. 10/059 059 or in the WO 01/20965 according to U.S. application Ser. No. 2002-0 037 087 or in the WO 01/22790 according to U.S. application Ser. No. 2002-0 090 098. In any case to the classifier and control units 12, $\mathbf{12}_w$ there is input information about the acoustical signals received at units 1, $\mathbf{1}_L$ and/or $\mathbf{1}_R$ as shown at 13 in FIG. 4, at 13*a*, 13*b* in FIG. 6. Under a second aspect of the present invention a preferred classification technique shall be described in the following, which is most apt to be combined with the present invention under its first aspect described up to now.

This second aspect of the invention is schematically shown in FIG. 7, by a representation in analogy to that used throughout the FIGS. 1 to 6. It comprises a reception unit 30 with at least two input acoustical to electrical converters. The unit 30 operates so as to generate an output electrical signal or data at output $A_{30}$ indicative of the spatial direction of arrival DOA with which an acoustical signal impinges upon the acoustical inputs of the input converters 31*a* and 31*b* as provided. Such a unit is known e.g. from the WO 00/68703 which accords with the U.S. application Ser. No. 09/636 443 and 10/180 585 of the same applicant. From the instantaneously monitored DOA there is generated by means of a processing unit 32 a histogram function of DOA. This is also known from the WO 00/68703. Thus, under the second aspect of the invention there is formed a histogram of the instantaneously prevailing DOA. According to the second aspect of the invention it is the DOA-histogram which is used as entity for classifying the acoustical signals in unit 34, which impinge upon the unit 30 and for controlling system adjustment especially according to FIGS. 4, 5, or 6. Thereby and as schematically shown in FIG. 7 by dashed-dotted lines, the reception unit 30 is preferably a part of a hearing device system 36. The signals or data representing audio signals are generated by unit 30 at output $A_{230}$, if that unit 30 performs combined tasks of DOA detection and audio signal processing. The histogram generated at unit 32 is now classified in classifying unit 34, which controls at its output most generically the behavior of a hearing device system, be it a monaural system, but most preferably of a binaural hearing device system as shown in FIGS. 1 to 6.

Accordingly in FIG. 8 there is shown more than one output of classifying unit 34 representing different controls to the hearing device system according to different types of histogram appearance and thus of acoustical source behavior in the acoustical surrounding U of FIG. 7 of the hearing device system, and thus of an individual carrying such system.

In FIG. 8*a* there is shown purely as an example such a histogram function represented by the overall time or in fact the overall number n of measuring samples, which result in a specific DOA spatial angle $\Phi$. For the DOA$\Phi_0$ a relatively sharp peak is present indicating that at that angle $\Phi_0$ to the acoustical input of the converters 31*a* and 31*b* there is a significant acoustical source in the acoustical surrounding U. At $\Phi_1$ there is a second yet less relevant acoustical source present in the surrounding U.

Departing from this histogram (a) some possible evaluations in time shall be discussed. According to FIG. 8(*b*) at the DOA $\Phi_0$ the peak has become broadened and its amplitude has dropped. This means e.g. that the acoustical source at the angle $\Phi_0$ has become diffuse, which may be caused by an increase of distance between the reception unit 30 and the acoustical source in the surrounding U. According to FIG. 8(*c*) and still considered as an evolution in time of the situation as present according to FIG. 8(*a*), it may be seen that the histogram has been shifted by an angle $\Delta$. This means that the reception unit 30 has rotated relative to the acoustical surrounding U, in other words that the individual carrying a system with unit 30 has turned his head by the angle $\Delta$. This is identified because the relative positioning of the sources in the surrounding U according to FIG. 8(*a*) at $\Phi_0$ and at $\Phi_1$ remains stable.

According to FIG. 8(*d*) the peak appearing at the DOA $\Phi_0$ according to FIG. (*a*) now appears at a different angle $\Phi_2$, whereas the source of at $\Phi_1$ according to fig. (*a*) still appears at the unchanged angle $\Phi_1$. This means that the source at $\Phi_0$ according to fig. (*a*) has moved to the new angular position $\Phi_2$, whereby the reception unit 30 has not rotated, i.e. the individual has kept his head stationary. From these explanations it may be seen which kind of criteria are used in classifying unit 34 of FIG. 8 to establish a relevant acoustical source, increasing distance, decreasing relevancy of a source, appearance/disappearance of a source movement of individual's head relative to the acoustical surrounding, angular movement of a source in the surrounding U, etc.

From combining and adding further classifying criteria an intelligent evaluation of the acoustical surrounding is performed and by the respective results the behavior of the hearing device system 34 is controlled. This may include source tracking by controlling beamforming and/or with an eye back on FIGS. 5 and 7 appropriate distribution of the influence or signal transfer of binaurally provided reception units upon binaurally provided output converters.

Thus under the second aspect the present invention is directed on classifying signals or data which are indicative of the DOA and controlling the status or behavior of a hearing device, be it a monaural or binaural device in dependency of the classification result. Thereby most preferably classification is performed upon data or signals wherefrom a histogram has been formed.

In FIG. 9 there is shown a preferred embodiment, which combines the invention under its first aspect realized as was explained with the help of FIG. 6 and under its second aspect.

A left ear reception unit $\mathbf{40}_L$ of a left ear hearing device is conceived as a beamformer with at least two input converters $\mathbf{41}_L$. The right ear hearing device, as an example, is equally construed as the left ear device and thus comprises a reception unit $\mathbf{40}_R$ equal to the unit $\mathbf{40}_L$. In analogy to the representation in FIG. 6 at the respective outputs $A_{1L}$, $A_{1R}$ electrical signals or data are generated as a result of processing the output signals of the converters 41. These signals are thus dependent on the acoustical signal impinging on the reception units, amplified according to the beamformer characteristics. The units 40 preferably comprise a respective beamformer control input $BFC_L$ and $BFC_R$, by which the shape of the beamformer characteristic, but especially the angle θ of maximal amplification may be adjusted. The units 40 further generate output signals, which are indicative of the DOAΦ of acoustical signals impinging on the acoustical inputs at the units 40. Signals or data dependent from these output signals $DOA_L$, $DOA_R$ are respectively input to histogram-forming units $\mathbf{44}_L$, $\mathbf{44}_R$. The units 40 combined with histogram-forming units 44 may and are preferably realized as described in the WO 00/68703, which accords with the U.S. application Ser. No. 09/636 443. Thereby and as seen in this paper the beamformers are based on the delay-and-add/subtract principal and thus the beamformer control input $BFC_L$ and $BFC_R$ may e.g. adjust the delay τ. It is well-known to the skilled artisan that by establishing and varying the delay τ in a delay-and-add/subtract based beamformer, the direction θ of maximum/minimum amplification is varied, i.e. the reception lobe of the beamformer is angularly shifted. As also disclosed in the WO 00/68703 and also preferably applied to the overall of the present invention, signal processing is performed in frequency mode and frequency-specifically. At the output of the histogram-forming units the instantaneously prevailing DOA-dependent histograms are present and signals or data dependent there from are fed to a histogram classification unit 46. Therein, the histogram courses resulting from left ear and right ear acoustical signal reception are evaluated, thereby preferably including comparing the histogram courses as prevailing at the units $\mathbf{44}_L$, $\mathbf{44}_R$.

In unit 46 on one hand the histogram courses per se are evaluated, e.g. and with an eye on FIG. 8 on peaks, width of the peaks, time behavior of the peaks etc., and the acoustical surrounding with respect to acoustical sources therein is respectively classified, as e.g. under the aspect of "acoustical source moving away", "acoustical source moving in the surrounding", "acoustical source becoming less relevant", "new acoustical source appearing", "acoustical source disappearing", "head of the individual moving", etc. Additionally the interrelation of both histogram courses is evaluated, thereby detecting how one of the histogram courses alters or appears with respect to the other side histogram course. This is for instance caused by the respective $HRTF_L$ and $HRTF_R$ becoming at the left and right ears (L, R) differently effective in dependency of DOAΦ. Instead of performing classification on the basis of DOA according to the second aspect of the present invention other classifications may be exploited as for instance described in the WO 02/32208 of the same applicant which accords with the U.S. application Ser. No. 10/059 059.

At the output of histogram classifying unit 46 there are generated control signals or data dependent on the classification result and from preset classification-dependent settings to be realized at the hearing device system. Thereby at the output of classification unit 46 a signal or data is generated, which is operationally connected to the beamformer control input $BFC_L$ and $BFC_R$ and on the other hand there is generated a control signal or data input to the weighting unit 49, which accords to the unit $\mathbf{9}_w$ of the system of FIG. 7. The beamformer control data and respective output is shown at BFC in FIG. 9, the weighting unit control signals or data and respective output of unit 46 by SC. The SC signals or data do control, as was more generically shown in FIG. 6 at the output of unit $\mathbf{12}_w$, the weighting unit 49 in that, shown by varying weighting coefficients α to γ in FIG. 6, the weights or transfer functions with which the output signals at outputs $A_{1L}$, $A_{1R}$ respectively act upon electrical/mechanical converters $\mathbf{47}_L$ and $\mathbf{47}_R$.

To further explain the embodiment of FIG. 9 let us make an example. To start with there shall appear in the Φ=0 DOA-direction with respect to the units 40 a significant acoustical source. The beamformers of the units 40 have their lobe directed on that source defining for Φ=θ=0. Both histograms at unit 44 may have e.g. a course as shown in FIG. 8(*a*). The histogram classification unit 46 recognizes histogram peaks for Φ=0 at both histograms, and this defines at unit 46 for a yet stable and significant acoustical source. Accordingly by means of BFC the beamformers are kept on θ=0. The SC control signal controls the selection unit 49 for equally weighted influence of signals or data appearing at both outputs $A_{1L}$ $A_{1R}$ upon the converters 47.

Now let's assume this relevant acoustic source in the acoustical surrounding U starts to move to the right-hand side of FIG. 9. This is recognizable at unit 46, because both histogram courses will show a development according to FIG. 8(*d*). Thus, unit 46 recognizes: "source is moving to the right". As the acoustical source considered leads still to a significant sharp peak in both histogram courses, the beamformers of units 40 are both controlled by the control signals or data BFC to follow that source. Still the SC control signals control selection unit 46 at least nearly for equally distributed weighting of the influence of the output signals $A_{1L}$ and $A_{1R}$ upon the converters $\mathbf{47}_L$ and $\mathbf{47}_R$.

As the acoustical source moves further to the right the head-related transfer function HRTF starts to influence the acoustical signals as impinging on the units 40. Whereas the right-hand side received acoustical signals will not be affected by the HRTF, the left-hand side received acoustical signals from that source become more and more influenced by HRTF as the acoustical source becomes "hidden" by the individual's head H. Therefore, the histogram course at unit $\mathbf{44}_R$ will still have a pronounced peak representing the source considered, whereas due to the HRTF the histogram course at unit $44_L$ will show at the angular position of the source considered, which is equal to the angular position of the peak in the histogram course at unit $44_R$, a more and more enlarged, less pronounced peak. This is, purely as an example, shown in FIG. 9 aside the histogram-forming units 44 and with respect to the same angular position $\Phi_s$ of the acoustical source considered. The classifying unit 46 recognizes by comparing the two histogram courses that at the same angular position $\Phi_s$ the left side histogram course has a widened and less pronounced peak with respect to the right-hand histogram course. This indicates the type of acoustical surrounding according to which a moving acoustical source has moved so far to the right that the respective HRTF function becomes effective. This means that the data from that source processed in the left ear unit $40_L$ become less accurate than the data processed in the right ear unit $40_R$ from that source and therefore the selection unit 49 is controlled to react on this specific exemplified situation by increasing the influencing of the right side signals or data at output $A_{1R}$ upon the converters $47_L$ and $47_R$. Thereby and e.g. within unit 49 the $HRTF_L$ function, which takes effect on the acoustical signals impinging upon the left side unit $40_L$, will be maintained with respect to data operationally acting upon converter $47_L$ in a most preferred mode, so as to maintain for the individual spatial perception of the acoustical source. With respect to beam control, as the DOA data of the right ear unit $40_R$ become according to this example more accurate than the respective data from unit $40_L$ e.g. due to higher level acoustic signals, also beamformer control will preferably be at least dominated by the DOA data from the right ear unit $40_R$ (not specifically shown in FIG. 9).

The weighting-coefficients or functions as of $\alpha$ to $\gamma$ of FIG. 6, are preferably complex valued, frequency or frequency band dependent functions. In the classifier unit also multiple acoustical source situations are detected and predetermined strategies are set, how to control on one hand the beamformers, on the other hand the signal transmission at weighting unit most suitably for specific acoustical surroundings.

Thus, by combining the two aspects of the present invention a binaural hearing device system is achieved, which incorporates "intelligent" system adjustment based on the evaluation of DOA histogram course.

Once again it must be emphasized that the data or signal processing functions which have been explained as by FIG. 9 may be split in a great variety of realization modes to the two hearing devices or may be centralized within a unit remote from the hearing devices, and accordingly the signal transmission link 5 from one ear side to the other will be provided. Further, the skilled artisan recognizes that the system as of FIG. 9 will incorporate different digital processing unit DSPs, especially along the double-arrowed operational connections so as to take into account specific hearing improvement needs at both individual's ears, HRTF functions etc.

As we have mentioned before one approach, which is today a preferred one, for and as a second aspect of the present invention is to provide classification of the acoustical surrounding of an individual so as to appropriately control a hearing device, being it a monaural or a binaural hearing device, based on evaluation of the direction of arrival DOA.

An approach how to determine the DOA is, as was explained before, explained in detail in the WO 00/68703. Based on that teaching, in FIG. 10 there is exemplified a binaural hearing device system whereat on one hand and according to the first aspect of the present invention combined data or signals from at least two input acoustical/electrical converters are respectively transmitting from one ear side to the other or in the case of a CIC-device with one input converter after having been processed by a Wiener-Filter. On the other hand the embodiment of FIG. 10 incorporates also the second aspect of the present invention realised on the basis as disclosed in the WO 00/68703. A left ear reception unit $50_L$ comprises two beamformers one defining a maximum amplification characteristic in DOA=0° direction, the other one in the backwards DOA =180° direction. In FIG. 10 the beamformers are exemplified as being equal first order cardoid beamformers.

Unit $50_L$ outputs at respective outputs $A_{50L1}$ and $A_{50L2}$ signals or data dependent on the impinging acoustical signals amplified by the respective DOA dependent amplification of the beamformers and frequency dependent.

These signals are respectively denoted in FIG. 10 by $S_{F1}$ and $S_{B1}$. This output signals are led after analogue/digital conversion (not shown) to time domain/frequency domain conversion units $52_{L1}$ and $52_{L2}$ resulting in frequency specific output signals or data $C_{B1}$ and $C_{F1}$. Signals dependent from the output signals of the conversion units 52 are further fed to absolute value forming units $54_{L2}$ and $54_{L1}$ outputing respective frequency specific signals or data $|C_{B1}|$ and $|C_{F1}|$. These absolute value signals or signals dependent there from are fed to a quotient forming or division unit $56_L$ outputing for left ear reception unit $50_L$ frequency specific a quotient $Q_L$. Signals or data dependent from that quotient $Q_L$ are subjected to histogram forming in a histogram forming unit $58_L$ outputing of histogram data $H_L$.

The right ear side with right ear reception unit $50_R$ up to data $H_R$ is preferably construed exactly equally to the left ear side as just described and will therefore not specifically be described again.

The histogram data from the two histogram forming units $58_L$ and $58_R$ are input to a classifying unit 60.

Further, signals dependent on the front-forwards beamformers at both reception units $50_L$ and $50_R$ namely $|C_{F1}|$ and $|C_{F2}|$ are fed to a further quotient forming unit $62_v$ and in analogy signals dependent from the output signal of the rear beamformers of both reception units as of $|C_{B1}|$ and $|C_{B2}|$ are fed to still further quotient forming unit $62_{Re}$. Signals or data dependent from the result at the said quotient forming units $62_v$ and $62_{Re}$ are input to respective histogram forming units $64_{Re}$ and $64_v$. The histogram data output by these histogram forming units are again input to the classification unit 60.

After classification, e.g. as will just be discussed, the classification unit 60 generates output signals or data which are operationally linked to a control input of the weighting unit 61. As a function of the classification result-data output by classification unit 60 signal transfer within weighting unit 61 is controlled, namely:

- from an input $E_{L1}$ to which signals dependent from the forward beamformer of unit $50_L$ are fed to output $A_L$ and output $A_R$ respectively,
- from an input $E_{L2}$ to which signals or data dependent from the output signals of the rear beamformer of unit $50_L$ are fed respectively to the output $A_L$ and $A_R$
- and in complete analogy, from the right ear input $E_{R1}$, $E_{R2}$ and to the said respective outputs $A_L$ and $A_R$. The signals output at $A_L$ and $A_R$ are operationally fed to the output electrical/mechanical converters $63_L$ and $63_R$ respectively.

We define:

$$Q_L = \frac{|C_{F1}|}{|C_{B1}|}$$

$$Q_R = \frac{|C_{F2}|}{|C_{B2}|}$$

$$Q_{Re} = \frac{|C_{B1}|}{|C_{B2}|}$$

$$Q_V = \frac{|C_{F1}|}{|C_{F2}|}$$

Let's discuss possible classification results and criteria exploited and generated at unit 60 whenever an acoustical signal source in the surrounding U is detected with different DOA's.

Whenever DOA Φ is between 0° and 90° following is valid:

$Q_L>1$ and $Q_v>1$.

It has to be noted that it is preferred to consider $Q_v$ in this case than $Q_{Re}$ because the acoustical signal impinges at the higher level on the forward beamformer of both units 50, the output signals of these beamformers being thus more accurate with respect to signal/noise than the output signals of the respective rear side beamformers.

The same is considered with respect to evaluating $Q_L$ or $Q_R$, the signals leading to $Q_L$ have a better signal/noise ratio than the signals leading to $Q_R$ because as the target acoustic source moves towards 90° the right side HRTF more and more influences signals received at the right ear unit $\mathbf{50}_R$. These considerations are made also in the following cases to be discussed and are not repeated.

As the target source is located at the DOA Φ between 90° and 180° the following is valid:

$Q_L<1$ and $Q_{Re}>1$.

As the target source moves on to a DOA Φ between 180° and 270° the following prevails:

$Q_R<1$ and $Q_{Re}<1$.

Finally as the target source moves to a position between 270° and 360° the following prevails:

$Q_R>1$ and $Q_v<1$.

Thus by evaluating these criteria, as a simplified example, within the classification unit 60 it is established around 360° where an acoustical source is located and accordingly in weighting unit 61 the respective signal transfer functions are set. As an example:

If the source is detected by the above criteria to be located at a DOA between 90° and 180° the rear side beamformer of left ear reception unit $\mathbf{50}_L$ will become master beamformer because that beamformer outputs a signal with best signal/noise ratio. Therefore the transfer functions or coefficients according to FIG. 6 from input $E_{L2}$ on the one hand to $A_L$ and on the other hand to $A_R$ will become governing. Thereby the transferred function from $E_{L2}$ to $A_R$ will consider the HRTF which is not influencing at the source position discussed signals impinging on the reception unit 50L but which must be considered for driving the right output converter 63R so as to maintain spatial source perception. Simplified the forward beamformer of unit 50L and both beamformers at unit 50R become slaves and their respective output signals are merely exploited to generate the respective quotients to allow the classification unit to properly classify the prevailing DOA so as to properly control signal transfer in weighting unit 61.

The invention claimed is:

1. A binaural hearing device system comprising:

a first reception unit;

a second reception unit;

a first output converter;

a second output converter;

a first device for one ear of an individual, said first device including said first reception unit, said first output converter, and a first signal processing unit having an input operationally connectable to an electrical output of said first reception unit;

a second device for the other ear of the individual, said second device including said second reception unit, said second output converter, and a second signal processing unit having an input operationally connectable to an electrical output of said second reception unit;

a data communication link connecting said first device and said second device, wherein said communication link is provided at an output side of said first processing unit and transmits signals dependent from said output signal of said first processing unit, and wherein said communication link is also provided at an output side of said second processing unit and transmits signals dependent from said output signal of said second processing unit; and a weighing unit including a first input, a second input, a first output, a second output, and a control input, wherein an output of said first signal processing unit is operationally connected to said first input of said weighting unit, and an output of said second signal processing unit is operationally connected to said second input of said weighting unit, and wherein said first output of said weighing unit is for operationally connecting to an input of said first output converter, and said second output of said weighing device is for operationally connecting to an input of said second output converter, and further wherein said weighing unit is adapted for providing said first output based on a first weighing of said first input and a second weighing of said second input, and wherein said weighing unit is further adapted for providing said second output based on a third weighing of said first input and a fourth weighing of said second input; and wherein said weighing unit is still further adapted such that said first, second, third and fourth weighings are capable of being configured independently of each other to different values and are controlled by a signal applied to said control input.

2. The binaural hearing device system of claim 1, wherein, said first reception unit including at least two acoustical/electrical input converters, and said second reception unit including at least two acoustical/electrical input converts, said first signal processing unit performing at least a Wiener filter operation upon the signal applied to said input.

3. The binaural hearing device system of claim 1, wherein each one of said first reception unit and said second reception unit comprises at least two acoustical/electrical converters, the outputs thereof being operationally connected to inputs of said respective processing unit.

4. The system of claim 1, wherein one of said first device and said second device does not comprise an electrical/mechanical output converter.

5. The system of claim 4, wherein the other of said first device and said second device does not comprise an input acoustical/electrical converter.

6. The system of claim 1, wherein each one of said first reception unit and said second reception unit comprises at least two acoustical/electrical converters, and wherein said data communication link includes one of a wire, an optical fiber, and a wireless communication link.

7. The system of claim 1, wherein said first reception unit includes at least two input acoustical/electrical converters and said second reception unit includes at least two input acoustical/electrical converters.

8. The system of claim 1, wherein said operational connections comprise frequency dependent, complex transfer functions, and wherein at least one of said first device and said second device further includes a beamformer unit with a beamcontrol input and with an output.

9. The system of claim 1, wherein said control input is operationally connected to an output of a classification unit with at least one input operationally connected to at least one output of at least one of said reception units, and wherein at least one of said first device and said second device further includes a beamformer unit with a beamcontrol input and with an output.

10. The system of claim 9, further comprising a determination unit for determining the direction of arrival of an acoustical signal, said determination unit being interconnected between said at least one input of said classification unit and said at least one output of said at least one reception unit, and wherein at least one of said first device and said second device further includes a beamformer unit with a beamcontrol input and with an output.

11. The system of claim 1, wherein at least one of said first device and said second device further includes a beamformer unit with a beamcontrol input and with an output, a detection unit for the direction of arrival of an acoustical signal impinging upon said first reception unit and generating an output signal, at an output, in dependency of said direction of arrival, said output of said direction of arrival detection unit being operationally connected to said beamcontrol input of said beamformer unit.

12. The system of claim 11, further comprising at least one histogram forming unit, the input thereof being operationally connected to said at least one output of said at least one reception unit, the output thereof being operationally connected to an input of said classification unit.

13. A binaural hearing device system comprising:

a first reception unit;

a second reception unit;

a first output converter;

a second output converter;

a first device for one ear of an individual, said first device including said first reception unit and said first output converter;

a second device for the other ear of the individual, said second device including said second reception unit and said second output converter;

a data communication link connecting said first device and said second device; and a weighing unit including a first input, a second input, a first output, a second output, and a control input, wherein said first output of said weighing unit is for operationally connecting to an input of said first a output converter, and said second output of said weighing device is for operationally connecting to an input of said second output converter, and further wherein said weighing unit is adapted for providing said first output based on a first weighing of said first input and a second weighing of said second input, and wherein said weighing unit is further adapted for providing said second output based on a third weighing of said first input and a fourth weighing of said second input; and wherein said weighing unit is still further adapted such that said first, second, third and fourth weighings are capable of being configured independently of each other to different values and are controlled by a signal applied to said control input.

14. The binaural hearing device system of claim 13, wherein said first reception unit includes at least two acoustical/electrical input converters, and said second reception unit includes at least two acoustical/electrical input converts.

15. The binaural hearing device system of claim 13, wherein each one of said first reception unit and said second reception unit comprises at least two acoustical/electrical converters, the outputs thereof being operationally connected to inputs of a respective processing unit.

16. The system of claim 13, wherein one of said first device and said second device does not comprise an electrical/mechanical output converter.

17. The system of claim 16, wherein the other of said first device and said second device does not comprise an input acoustical/electrical converter.

18. The system of claim 13, wherein each one of said first reception unit and said second reception unit comprises at least two acoustical/electrical converters, and wherein said data communication link includes one of a wire, an optical fiber, and a wireless communication link.

19. The system of claim 13, wherein said first reception unit includes at least two input acoustical/electrical converters and said second reception unit includes at least two input acoustical/electrical converters.

20. The system of claim 13, wherein said operational connections comprise frequency dependent, complex transfer functions, and wherein at least one of said first device and said second device further includes a beamformer unit with a beamcontrol input and with an output.

21. The system of claim 13, wherein said control input is operationally connected to an output of a classification unit with at least one input operationally connected to at least one output of at least one of said reception units, and wherein at least one of said first device and said second device further includes a beamformer unit with a beamcontrol input and with an output.

22. The system of claim 21, further comprising a determination unit for determining the direction of arrival of an acoustical signal, said determination unit being interconnected between said at least one input of said classification unit and said at least one output of said at least one reception unit, and wherein at least one of said first device and said second device further includes a beamformer unit with a beamcontrol input and with an output.

23. The system of claim 13, wherein at least one of said first device and said second device further includes a beamformer unit with a beamcontrol input and with an output, a detection unit for the direction of arrival of an acoustical signal impinging upon said first reception unit and generating an output signal, at an output, in dependency of said direction of arrival, said output of said direction of arrival detection unit being operationally connected to said beam-control input of said beamformer unit.

24. The system of claim 23, further comprising at least one histogram forming unit, the input thereof being operationally connected to said at least one output of said at least one reception unit, the output thereof being operationally connected to an input of said classification unit.

* * * * *